US008266855B1

(12) United States Patent
Altararwah

(10) Patent No.: US 8,266,855 B1
(45) Date of Patent: Sep. 18, 2012

(54) SYSTEM OF INTERLOCKING CONCRETE BLOCKS

(76) Inventor: Najem Altararwah, Berea, KY (US)

( * ) Notice: Subject to any disclaimer, the term of this patent is extended or adjusted under 35 U.S.C. 154(b) by 148 days.

(21) Appl. No.: 12/958,696

(22) Filed: Dec. 2, 2010

(51) Int. Cl.
*E04B 1/00* (2006.01)

(52) U.S. Cl. ..... 52/284; 52/275; 52/286; 52/569; 52/574; 52/596; 52/604

(58) Field of Classification Search ..... 52/284, 52/275, 282.3, 286, 569, 572, 574, 596, 599, 52/603, 604, 608, 609, 561, 570, 571; D25/113
See application file for complete search history.

(56) References Cited

U.S. PATENT DOCUMENTS 3,102,367 A * 9/1963 Martin et al. ..... 52/592.2
3,800,494 A * 4/1974 Hall et al. ..... 403/331
4,633,630 A * 1/1987 Kindylides ..... 52/204.2
5,687,531 A * 11/1997 Nelson et al. ..... 110/338
5,934,037 A 8/1999 Bundra
6,151,842 A 11/2000 Hododi
D437,366 S 2/2001 Stemmler
6,438,915 B1 * 8/2002 Beauboeuf ..... 52/271
2002/0046529 A1 4/2002 Nanayakkara
2006/0005500 A1 1/2006 Hovnanian
2008/0184649 A1 8/2008 Khan

* cited by examiner

*Primary Examiner* — William V. Gilbert
*Assistant Examiner* — Patrick Maestri

(57) ABSTRACT

A building block system for building concrete block walls. The system features a main block, a first corner block, a second corner block, a first end block, and a second end block. The blocks interlock with each other via first mating components, second mating components, third mating components, and upper protrusions disposed on various ends of the various blocks. Many of the blocks feature a center aperture, which can engage the mating components and upper protrusions. Generally, the first mating components and upper protrusions can engage the second mating components.

6 Claims, 6 Drawing Sheets

SYSTEM OF INTERLOCKING CONCRETE BLOCKS

FIELD OF THE INVENTION

The present invention is directed to building blocks, more particularly to a set of building blocks that can interlock with each other above, below, and from side to side.

BACKGROUND OF THE INVENTION

Creating solid and durable structures such as concrete walls or buildings can require a great deal of time and materials. For example, the concrete blocks have to be aligned properly and sealed together. The present invention features a system of interlocking concrete blocks. The system of the present invention allows a concrete wall to be easily and quickly constructed. The blocks may be arranged and installed without mortar between the joints.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a building block system. In some embodiments, the system comprises a main block having a first end and a second end, wherein a first mating component extends each outwardly, upwardly, and downwardly from the first end, wherein a second mating component extends each outwardly, upwardly, and downwardly from the second end, wherein a main block aperture is disposed in a center of the main block extending from a top surface to a bottom surface; a first corner block having a first end and a second end, wherein a first mating component extends each outwardly, upwardly, and downwardly from the first end, wherein a first upper protrusion extends upwardly from a top surface of the first corner block at the second end, wherein a first corner block aperture is disposed in a center of the first corner block extending from a top surface to a bottom surface; a second corner block having a first end, a second end, a third end, and a fourth end, wherein a first mating component extends each outwardly, upwardly, and downwardly from the first end, wherein the second end is generally flat, wherein a third mating component extends each outwardly, upwardly, and downwardly from the third end, wherein a second corner block aperture is disposed in a center of the second corner block extending from a top surface to a bottom surface; a first end block having a first end and a second end, wherein the first end is generally flat, wherein a second mating component extends each outwardly, upwardly, and downwardly from the second end, wherein a first end block aperture is disposed in a center of the first end block extending from a top surface to a bottom surface; and a second end block having a first end and a second end, wherein the first end is generally flat, wherein a second mating component extends each outwardly, upwardly, and downwardly from the second end. The first mating components are each adapted to engage a second mating component, wherein the first upper protrusion can engage a second mating component.

In some embodiments, the first mating component and/or the second mating component and/or the third mating component resembles a capitalized gamma or a capitalized J. In some embodiments, each first mating component and each second mating component has an upper extension extending above a top surface of the respective block and a lower extension extending below a bottom surface of the respective block, the upper extensions and lower extensions are adapted to engage an aperture disposed in a block. In some embodiments, the system further comprises an alternative block having a generally L-shape, wherein a first protrusion extends upwardly from a second end, the second end being a shorter end.

DESCRIPTION OF PREFERRED EMBODIMENTS

Figure 1:
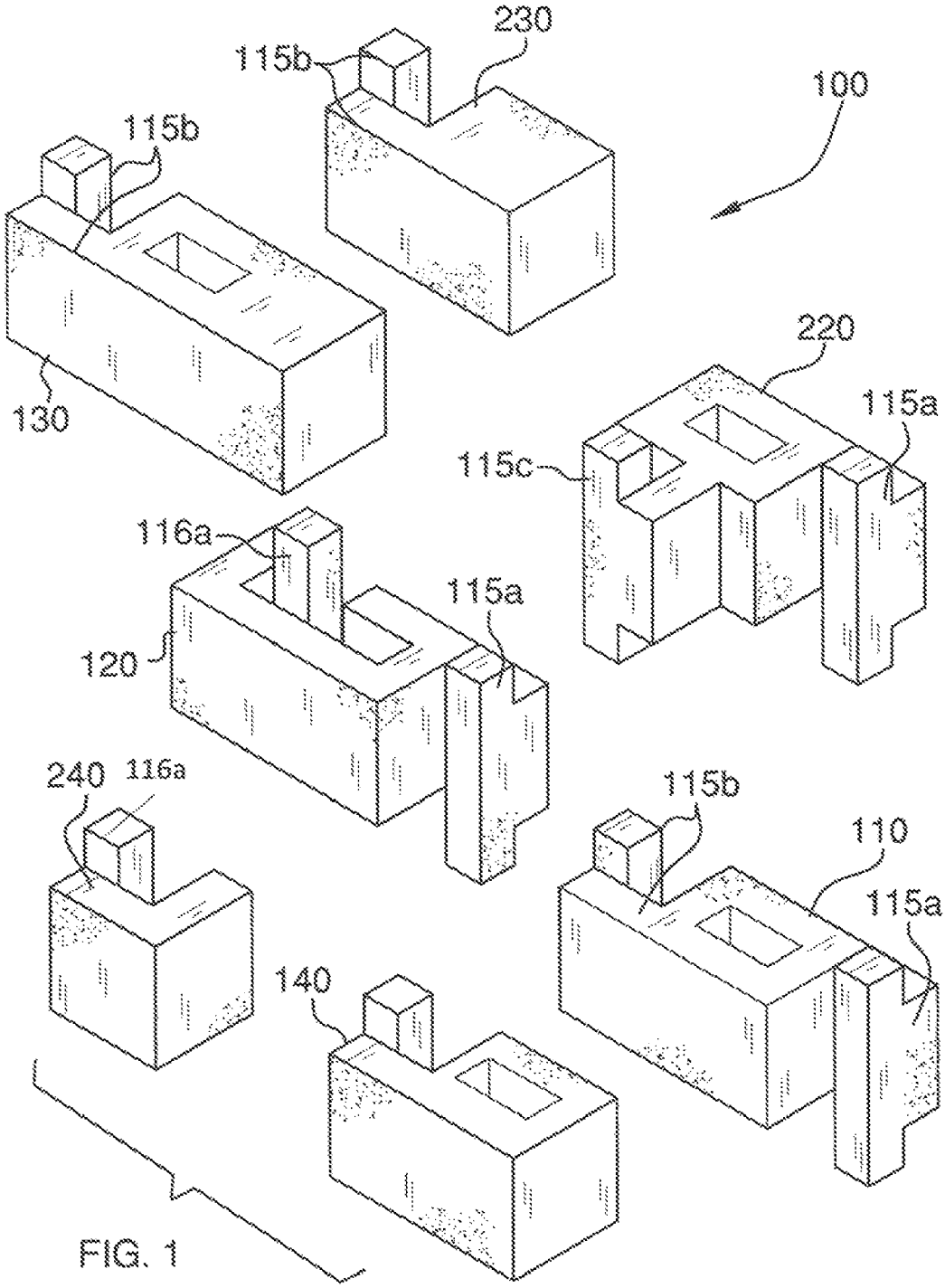
FIG. 1 is an exploded view of components of the building block system of the present invention.

Referring now to FIGS. 1-6, the present invention features a building block system 100 comprising a plurality of interlocking concrete blocks. The system 100 of the present invention features an improved design for concrete blocks. The blocks of the system 100 can be stacked on top of one another and automatically aligned with each other. The system 100 further comprises blocks for joints (e.g., corners) and ends of walls or other structures.

The system 100 of the present invention comprises a main block 110, a first corner block 120, a second corner block 220, a first end block 130, and a second end block 230. The main block 110 has a first end and a second end. A first mating component (e.g., hook-like structure) 115*a* is extends outwardly from the first end and a second mating component 115*b* is extends outwardly from the second end of the main block 110.

The first corner block 120 has a first end and a second end. A first mating component 115*a* extends outwardly from the first end. A first upper protrusion 116*a* extends upwardly from the top surface of the first corner block 120 at the second end. The second corner block 220 has a first end, a second end, a third end, and a fourth end. A first mating component 115*a* extends outwardly from the first end. The second end of the second corner block 220 is generally flat. A third mating component 115*c* extends outwardly from the third end (at the intersection with the second end).

The first end block 130 and the second end block 230 have a first end and a second end. The first end of the first end block 130 and the first end of the second end block 230 are generally flat. A second mating component extends outwardly from the second end of the first end block 130 and from the second end of the second end block 230.

The first mating components 115*a* each extend downwardly from the bottom surface of the respective block. The second mating components 115*b* each extend upwardly from the top surface of the respective block. The first mating component 115*a* is adapted to engage a second mating component 115 of a different block. The first upper protrusion 116*a* can engage a second mating component 115*b*.

Figure 2:
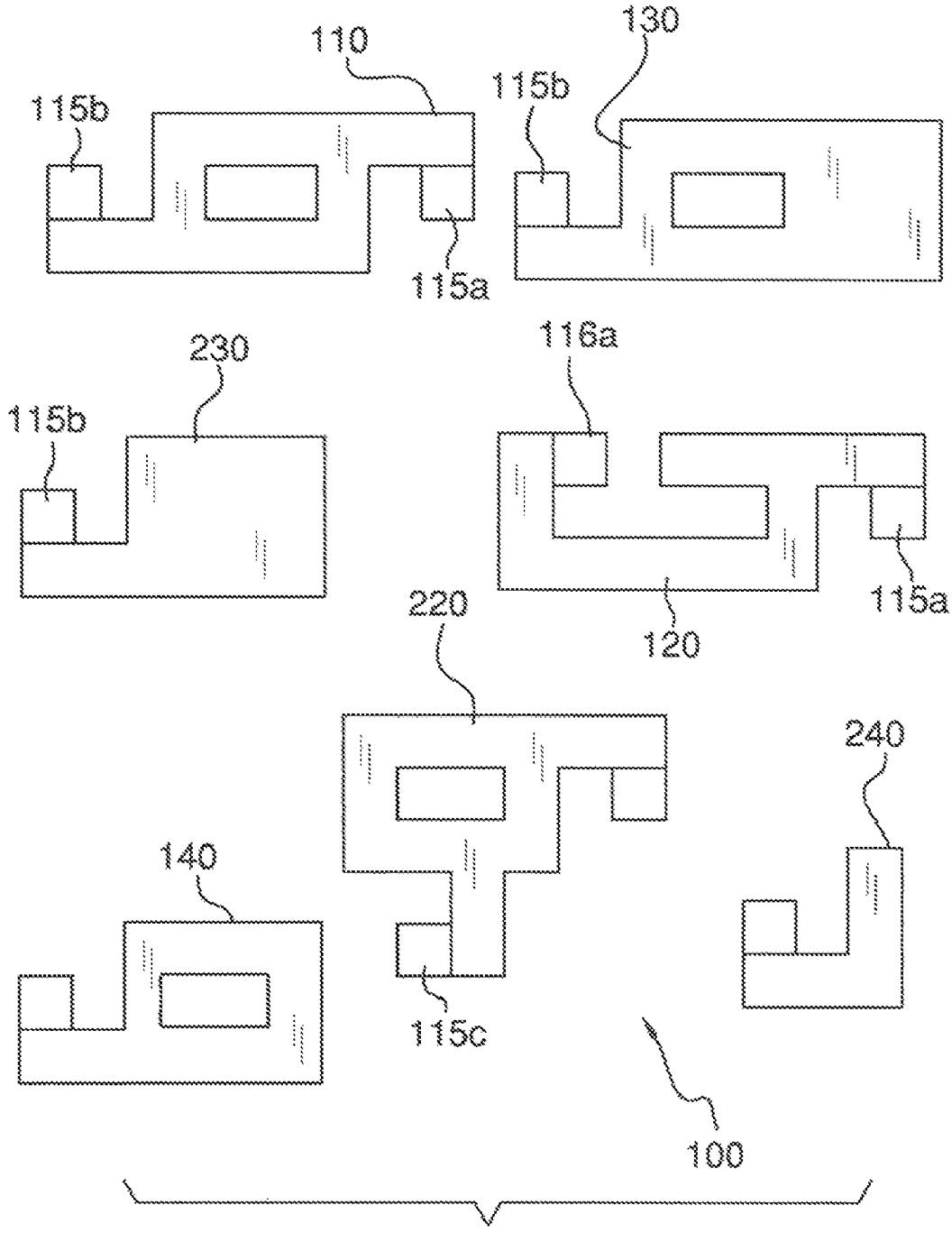
FIG. 2 is a top view of the components of the building block system of FIG. 1.

As shown in FIG. 2 (e.g., as viewed from above), in some embodiments, the first mating component 115*a* resembles a gamma shape (capitalized gamma) or a J-shape (capitalized J). In some embodiments, the second mating component 115*b* resembles a gamma shape (capitalized gamma) or a J-shape (capitalized J). In some embodiments, the third mating component 115*c* resembles a gamma shape or a J-shape (capitalized J).

A main block aperture is disposed in the main block 110. A first corner block aperture is disposed in the first corner block 120. A second corner block aperture is disposed in the second corner block 220. A first end block aperture is disposed in the first end block 130. The apertures extend from the top surface to the bottom surface.

Figure 3:
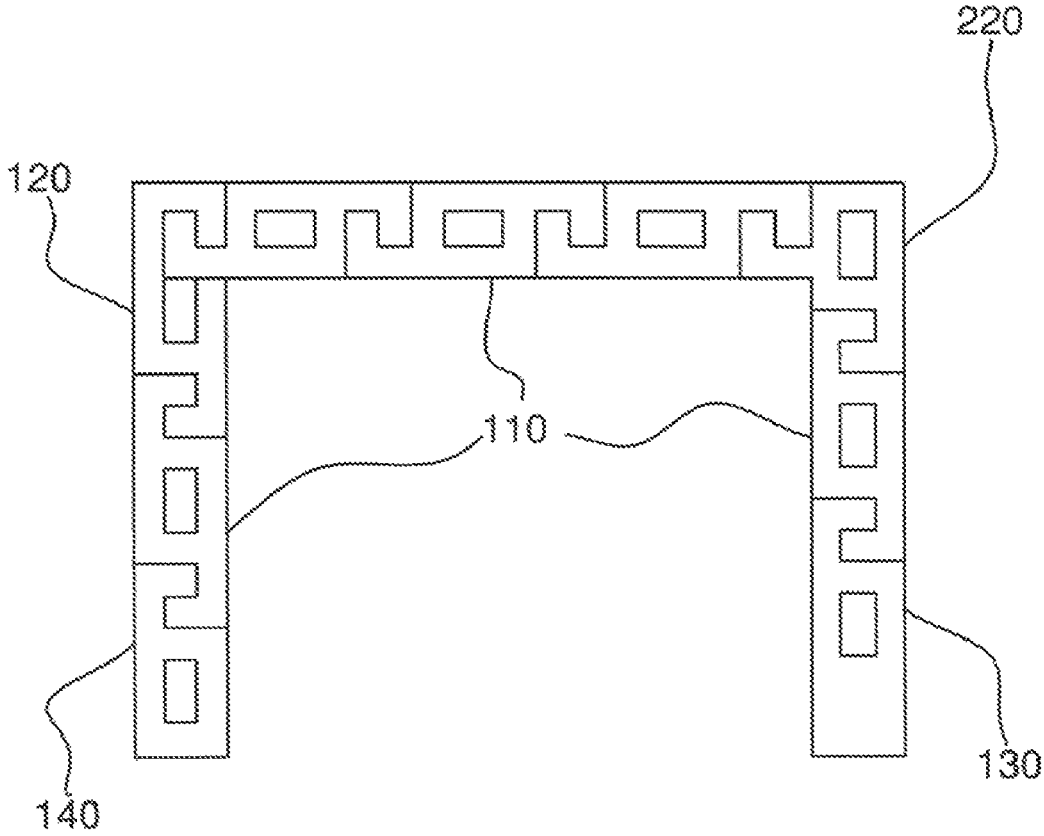
FIG. 3 is a top view of the building block system of the present invention used to create a first layer for a wall-like structure.
Figure 4:
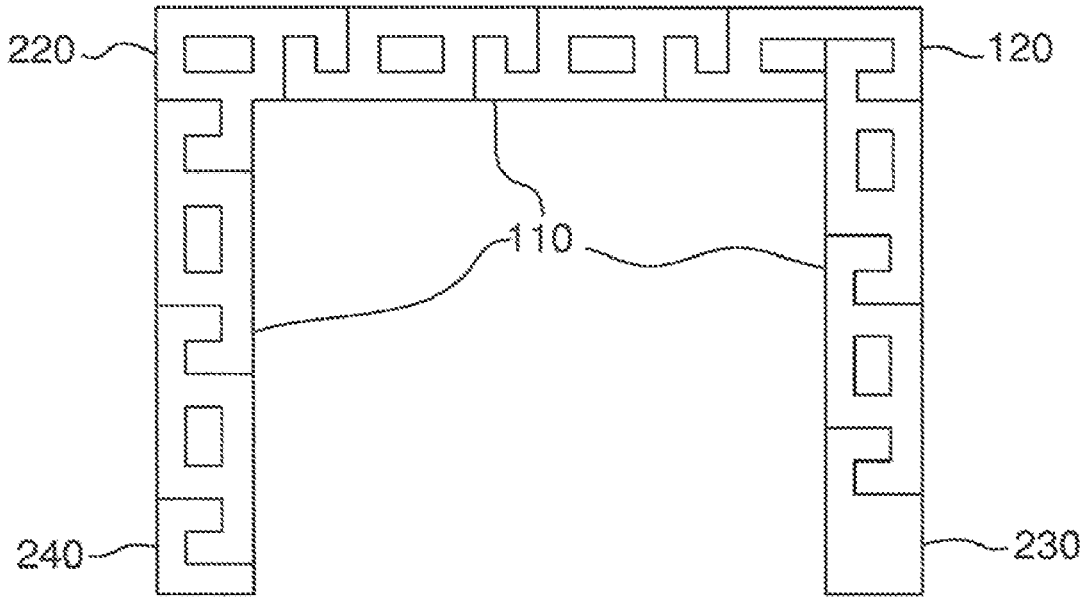
FIG. 4 is a top view of the building block system of the present invention used to create a second layer for a wall-like structure.

FIG. 3 and FIG. 4 show examples of walls that can be constructed using the system 100 of the present invention. The layer in FIG. 4 may be placed atop the layer shown in FIG. 3. The top to bottom interlocking may feature a three point means of interlocking.

Figure 5:
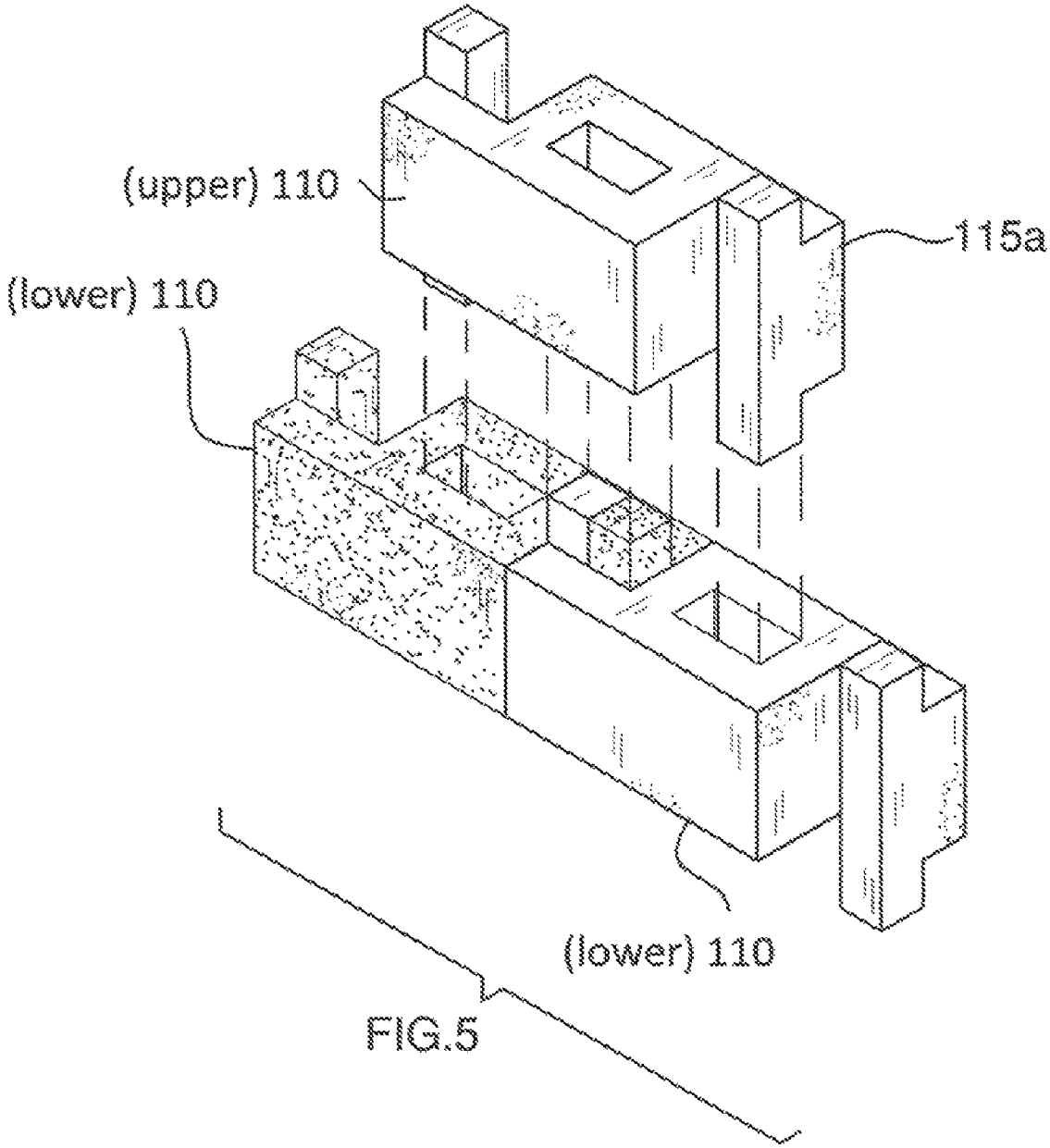
FIG. 5 is an exploded view of a second layer of building blocks engaging a first layer of building blocks.

As shown in FIG. 5, the extensions (upper or lower) of the first mating components 115*a* and second mating components 115*b* (as well as the first protrusion 116*a*) allow for the ability of the blocks to interlock with upper and lower layers (e.g., and allow for alignment of the blocks horizontally). For example, the lower extension of the first mating component 115*a* of an upper main block 110 can engage the main block aperture of a first lower main block in a lower layer. The lower extension of the second mating component 115*b* of the upper main block 110 can engage the main block aperture of a second lower main block 110 in the lower layer. The upper extension of the second mating component 115*b* of the first lower main block 110 can engage the main block aperture of the upper main block 110. The upper extension of the first mating component 115*a* of the second lower main block 110 can engage the main block aperture of the upper main block 110.

To build a structure such a wall, a plurality of systems 100 of the present invention may be used (e.g., a plurality of main blocks 110 may be used to make a wall longer).

Figure 6:
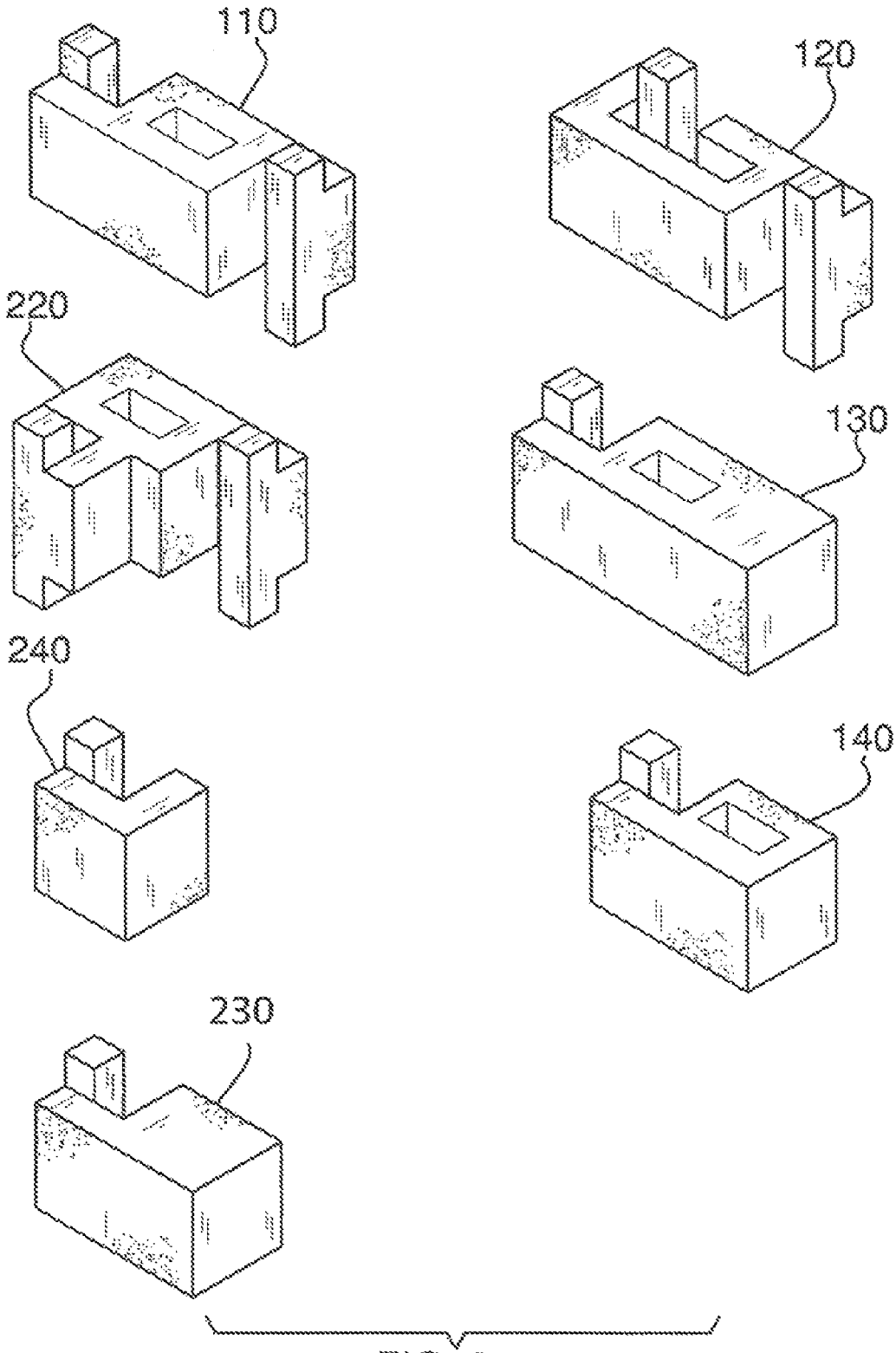
FIG. 6 is an exploded view of components of the building block system of the present invention.

As shown in FIG. 1 and FIG. 6, the system 100 may further comprise a first alternative block 140 resembling the second end block 230, however a hold is disposed in the first alternative block 140. The system 100 may further comprise a second alternative block 240 having a generally L-shape. A first protrusion 116*a* is disposed on the second end of the second alternative block 240, wherein the second end is the shorter end of the L-shape.

The following the disclosures of the following U.S. Patents are incorporated in their entirety by reference herein: U.S. Pat. Application No. 2008/0184649; U.S. Pat. Application No. 2006/0005500; U.S. Pat. Application No. 2002/0046529; U.S. Pat. No. 6,151,842; U.S. Pat. No. 5,934,037; U.S. Design Pat. No. D437,366.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A building block system comprising (a) a main block having a first end and a second end, wherein a first mating component extends each outwardly, upwardly, and downwardly from the first end, wherein a second mating component extends each outwardly, upwardly, and downwardly from the second end, wherein a main block aperture is disposed in a center of the main block extending from a top surface to a bottom surface;

(b) a first corner block having a first end and a second end, wherein a first mating component extends each outwardly, upwardly, and downwardly from the first end, wherein a first upper protrusion extends upwardly from a top surface of the first corner block at the second end, wherein a first corner block aperture is disposed in a center of the first corner block extending from a top surface to a bottom surface;

(c) a second corner block having a first end, a second end, a third end, and a fourth end, wherein a first mating component extends each outwardly, upwardly, and downwardly from the first end, wherein the second end is generally flat, wherein a third mating component extends each outwardly, upwardly, and downwardly from the third end, wherein a second corner block aperture is disposed in a center of the second corner block extending from a top surface to a bottom surface;

(d) a first end block having a first end and a second end, wherein the first end is generally flat, wherein a second mating component extends each outwardly, upwardly, and downwardly from the second end, wherein a first end block aperture is disposed in a center of the first end block extending from a top surface to a bottom surface; and (e) a second end block having a first end and a second end, wherein the first end is generally flat, wherein a second mating component extends each outwardly, upwardly, and downwardly from the second end;

wherein the first mating components are each adapted to engage a second mating component, wherein the first upper protrusion can engage a second mating component.

2. The system of claim 1, wherein the first mating component resembles a capitalized gamma or a capitalized J.

3. The system of claim 1, wherein the second mating component resembles a capitalized gamma or a capitalized J.

4. The system of claim 1, wherein the third mating component resembles a capitalized gamma or a capitalized J.

5. The system of claim 1, wherein each first mating component and each second mating component has an upper extension extending above a top surface of the respective block and a lower extension extending below a bottom surface of the respective block, the upper extensions and lower extensions are adapted to engage an aperture disposed in a block.

6. The system of claim 1 further comprising a second alternative block having a generally L-shape, wherein a first protrusion extends upwardly from a second end, the second end being a shorter end.

* * * * *